US012680721B2

(12) United States Patent
Edwards

(10) Patent No.: US 12,680,721 B2
(45) Date of Patent: Jul. 14, 2026

(54) HIGH EFFICIENCY ARCHITECTURE AND CONTROL SCHEME FOR SOLID-STATE HVAC APPLICATIONS

(71) Applicant: Phononic, Inc., Durham, NC (US)

(72) Inventor: Jesse W. Edwards, Wake Forest, NC (US)

(73) Assignee: Phononic, Inc., Durham, NC (US)

( * ) Notice: Subject to any disclaimer, the term of this patent is extended or adjusted under 35 U.S.C. 154(b) by 117 days.

(21) Appl. No.: 18/526,979

(22) Filed: Dec. 1, 2023

(65) Prior Publication Data

US 2024/0183563 A1 Jun. 6, 2024

Related U.S. Application Data

(60) Provisional application No. 63/385,677, filed on Dec. 1, 2022.

(51) Int. Cl.
*F24F 11/80* (2018.01)
*F24F 5/00* (2006.01)
(Continued)

(52) U.S. Cl.
CPC ..... *F24F 11/80* (2018.01); *F24F 5/0042* (2013.01); *F24F 11/46* (2018.01); *F24F 2110/10* (2018.01); *F24F 2110/20* (2018.01)

(58) Field of Classification Search
CPC .... F24F 11/80; F24F 5/0042; F24F 2013/144; F25D 2317/0684; F25B 21/02
See application file for complete search history.

(56) References Cited

U.S. PATENT DOCUMENTS

2006/0137359 A1* 6/2006 Ghoshal ..... H10N 10/13 62/3.2
2010/0256824 A1* 10/2010 Val-Khvalabov ..... F24F 11/77 700/282

(Continued)

FOREIGN PATENT DOCUMENTS

WO 2010102231 A1 9/2010
WO 2013169772 A1 11/2013

OTHER PUBLICATIONS

International Search Report and Written Opinion for International Patent Application No. PCT/US2023/082136, mailed Mar. 6, 2024, 14 pages.

*Primary Examiner* — Nelson J Nieves
(74) *Attorney, Agent, or Firm* — Withrow + Terranova, PLLC

(57) ABSTRACT

Systems and methods for controlling a heat exchanger comprising multiple thermoelectric coolers to provide conditioned air are provided. The method includes receiving system measurements indicative of one or more of the group consisting of: a temperature of a accept-side of a first thermoelectric cooler; a temperature of a reject-side of the first thermoelectric cooler; a temperature of a accept-side of a second thermoelectric cooler; a temperature of a reject-side of the second thermoelectric cooler; an indication of a direction of air flow in the heat exchanger; and an indication of a relative humidity value. The method also includes selectively controlling two or more subsets of thermoelectric coolers in the plurality of thermoelectric coolers based on the received system measurements. This allows for increased efficiency of the heat exchanger.

20 Claims, 11 Drawing Sheets

(51) Int. Cl.

| | |
|---|---|
| ***F24F 11/46*** | (2018.01) |
| *F24F 110/10* | (2018.01) |
| *F24F 110/20* | (2018.01) |

(56) References Cited

U.S. PATENT DOCUMENTS

| | | | | |
|---|---|---|---|---|
| 2011/0017252 | A1* | 1/2011 | Braun | H05K 7/206 136/204 |
| 2012/0055170 | A1* | 3/2012 | Lilke | F24H 3/0411 165/61 |
| 2015/0233613 | A1* | 8/2015 | Cho | H10N 10/13 62/3.3 |
| 2022/0221176 | A1 | 7/2022 | Rodrigues et al. | |

* cited by examiner

HIGH EFFICIENCY ARCHITECTURE AND CONTROL SCHEME FOR SOLID-STATE HVAC APPLICATIONS

RELATED APPLICATIONS

This application claims the benefit of provisional patent application Ser. No. 63/385,677, filed Dec. 1, 2022, the disclosure of which is hereby incorporated herein by reference in its entirety.

FIELD OF THE DISCLOSURE

The present disclosure relates generally to controlling air conditioning applications.

BACKGROUND

Traditional Heating Ventilation and Air-conditioning (HVAC) applications desire, target and generate a significant temperature difference between the conditioned and unconditioned space, in order to provide acceptable performance and comfort, to be delivered to the user.

Generating a large temperature difference between conditioned and unconditioned space, by traditional methods of integration, will generally, put a solid-state heating and cooling system at a disadvantage over traditional (e.g. vapor compression based) heat pumping systems.

Thermodynamically simplified, the larger the temperature difference generated in a heat-pumping system, the lower the efficiency the heat pumping system can achieve. As such, traditional solid-state heating and cooling implementation methods place any application of solid-state heat-pumping methods at a potential disadvantage to alternative technologies.

SUMMARY

Systems and methods for controlling a heat exchanger comprising multiple thermoelectric coolers to provide conditioned air are provided. The method includes receiving system measurements indicative of one or more of the group consisting of: a temperature of a accept-side of a first thermoelectric cooler; a temperature of a reject-side of the first thermoelectric cooler; a temperature of a accept-side of a second thermoelectric cooler; a temperature of a reject-side of the second thermoelectric cooler; an indication of a direction of air flow in the heat exchanger; and an indication of a relative humidity value. The method also includes selectively controlling two or more subsets of thermoelectric coolers in the plurality of thermoelectric coolers based on the received system measurements. This allows for increased efficiency of the heat exchanger.

At lower device and system deltas, a solid-state heating/cooling system can deliver extremely high efficiency operation. And, as a solid-state system has the potential for 100% modulation from zero to full capacity, these types of systems can leverage the variable nature of the demand in HVAC applications, more effectively than fixed temperature delta systems. However, as temperature deltas, and therefore demand, increase, the efficiency of the solid-state system will drop, if not integrated and managed effectively.

In some embodiments, the indication of the direction of air flow in the heat exchanger comprises one of: parallel air flow; and counter air flow.

In some embodiments, when the indication of the direction of air flow in the heat exchanger comprises counter air flow, selectively controlling the two or more subsets of thermoelectric coolers comprises: being able to provide more equal power to the two or more subsets of thermoelectric coolers.

In some embodiments, when the indication of the direction of air flow in the heat exchanger comprises parallel air flow, selectively controlling the two or more subsets of thermoelectric coolers comprises: providing different power to the two or more subsets of thermoelectric coolers.

In some embodiments, the system measurements further comprise an indication of a volume of air flow.

In some embodiments, selectively controlling the two or more subsets of thermoelectric coolers comprises: attempting to optimize a system-level efficiency of the heat exchanger.

In some embodiments, selectively controlling the two or more subsets of thermoelectric coolers comprises: providing an overall temperature difference by providing a smaller temperature difference over each of the two or more subsets of thermoelectric coolers.

In some embodiments, selectively controlling the two or more subsets of thermoelectric coolers comprises: adjusting the relative humidity in one or more of: the reject-side; and accept-side.

In some embodiments, the heat exchanger comprises a plurality of controllers to selectively control the two or more subsets of thermoelectric coolers.

In some embodiments, each subset of thermoelectric coolers includes one or more different thermoelectric coolers from the plurality of thermoelectric coolers.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1:
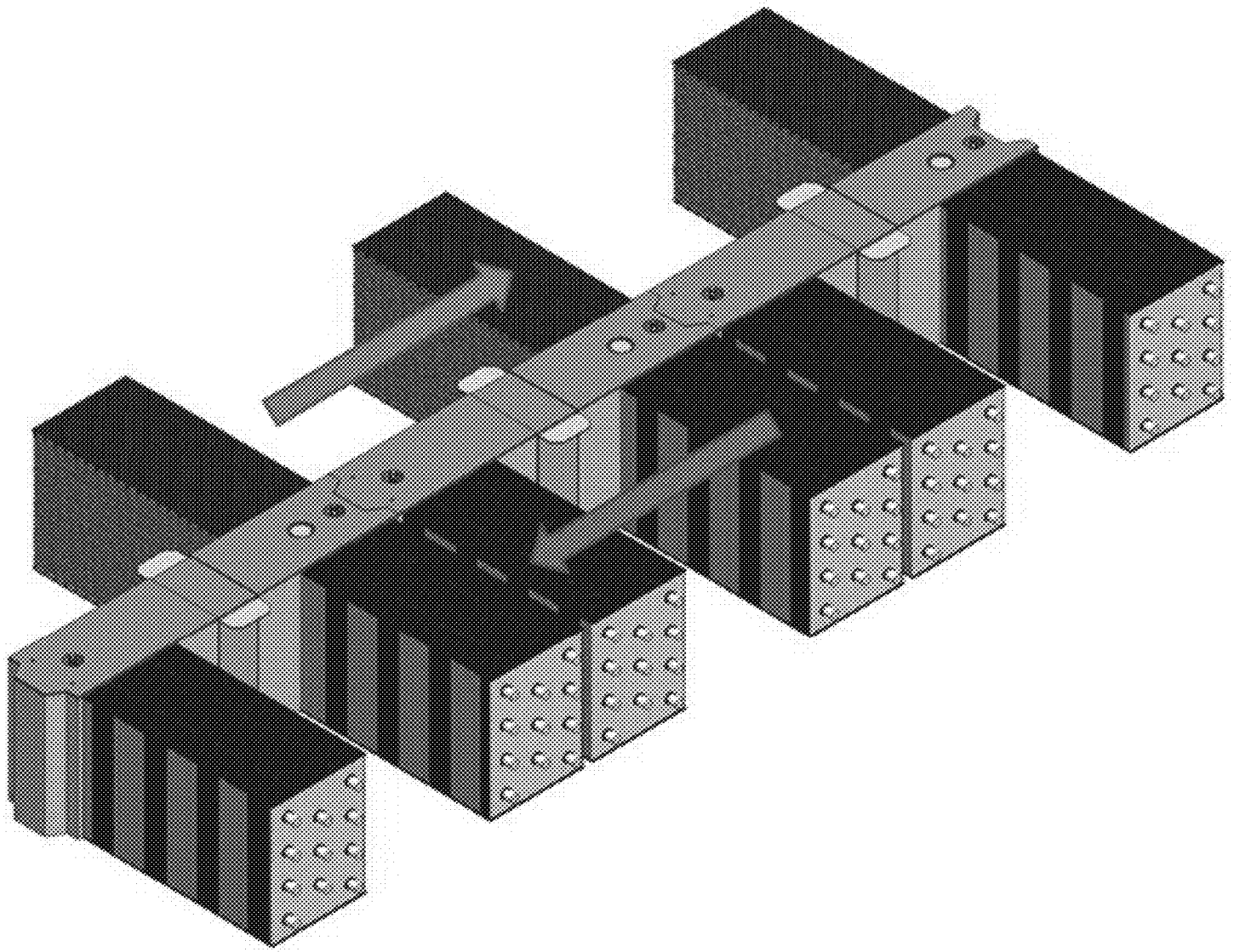
FIG. 1 illustrates a heat exchanger comprising multiple thermoelectric coolers configured, thermodynamically, in a series orientation, with a counter-flow source/sink mass flow configuration.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

At lower device and system deltas, a solid-state heating/cooling system can deliver extremely high efficiency operation. And, as a solid-state system has the potential for 100% modulation from zero to full capacity, these types of systems can leverage the variable nature of the demand in HVAC applications, more effectively than fixed temperature delta systems. However, as temperature deltas, and therefore demand, increase, the efficiency of the solid-state system will drop, if not integrated and managed effectively.

In order to take advantage of the high efficiency potential, of solid-state based systems, achievable at lower temperature differences, as well as overcome the reduced capacity of the same systems, when operating at higher efficiency operating points, the entire system must be designed such that it can leverage the thermodynamic properties of the solid-state materials and devices being used to pump heat from source to sink. This includes not only the lower efficiency at higher temperature differences and capacities but also the temperature dependent nature of the solid-state materials themselves, along with the internal system parasitics and the methods by which the system is regulated and controlled. To be effective the system must optimize and manage a multivariate set of mutually incompatible areas including but not limited to:

1. Heat-pump selection
2. Capacity optimization
3. Efficiency (COP) optimization
4. Heat flux
5. Heat transfer
6. Heat transport
7. Thermal resistance
8. System Architecture
9. Controls/Power Fundamentally, in order to be effective, the system must manage multiple elements of Physical properties, function, potential and control. This includes (but is not limited to); Heat-pump properties, Internal parasitics, Heat transport efficiency/capacity, System regulation/control and power conversion/delivery. Due to the unique operating and intrinsic properties of typical solid-state heat-pumps and the materials used to create them, implementation of a solid-state solution in an HVAC application is best served by breaking down the full system delta into smaller, manageable, sub-delta segments, managed and served by separate physical modules. The number of sub-delta modules is a function of the desired efficiency, capacity, dimension constraints and economics of the system/market demand. Unfortunately, by itself, the breakdown of the overall delta is only marginally effective at improving system performance, because in real-world application, each sub-delta module, will be operating not only at a different absolute accept-side and reject-side temperature but also a different temperature delta between the two sides. If operated in this un-optimized state, the overall performance of the system can be compromised significantly and produce a much less than desired output.

When a solid-state system is properly leveraged in a system level implementation, the effective operating temperature of the individual heat exchanger is critical to the performance and modeling conditions. Internal parasitics, starting from the base solid-state materials utilized, through the heat transport, power conversion and controls, to the full system architecture must be minimized for the system to achieve maximum efficiency. The primary, system-level metric, is generally considered to be the thermal resistance of the system, from source to heat-pump and from heat-pump to sink. While the total thermal resistance of the system, from Source to Sink, can be calculated and measured, these two metrics should be considered separately, to effectively characterize the transport efficiency of the system, as contact resistance, internal efficiency losses of the heat transport mechanism, and the inherent temperature discontinuity between the source and sink sides of the heat-pumping device, can have a significant performance impact, when accounted for in their entirety.

The initial step in optimizing a system broken into sub-delta modules, for maximized capacity and efficiency, is to configure the system architecture such that the system source/sink interfaces for the separate modules are configured, thermodynamically, in a series orientation, with a counter-flow source/sink mass flow configuration (FIG. 1).

Figure 2:
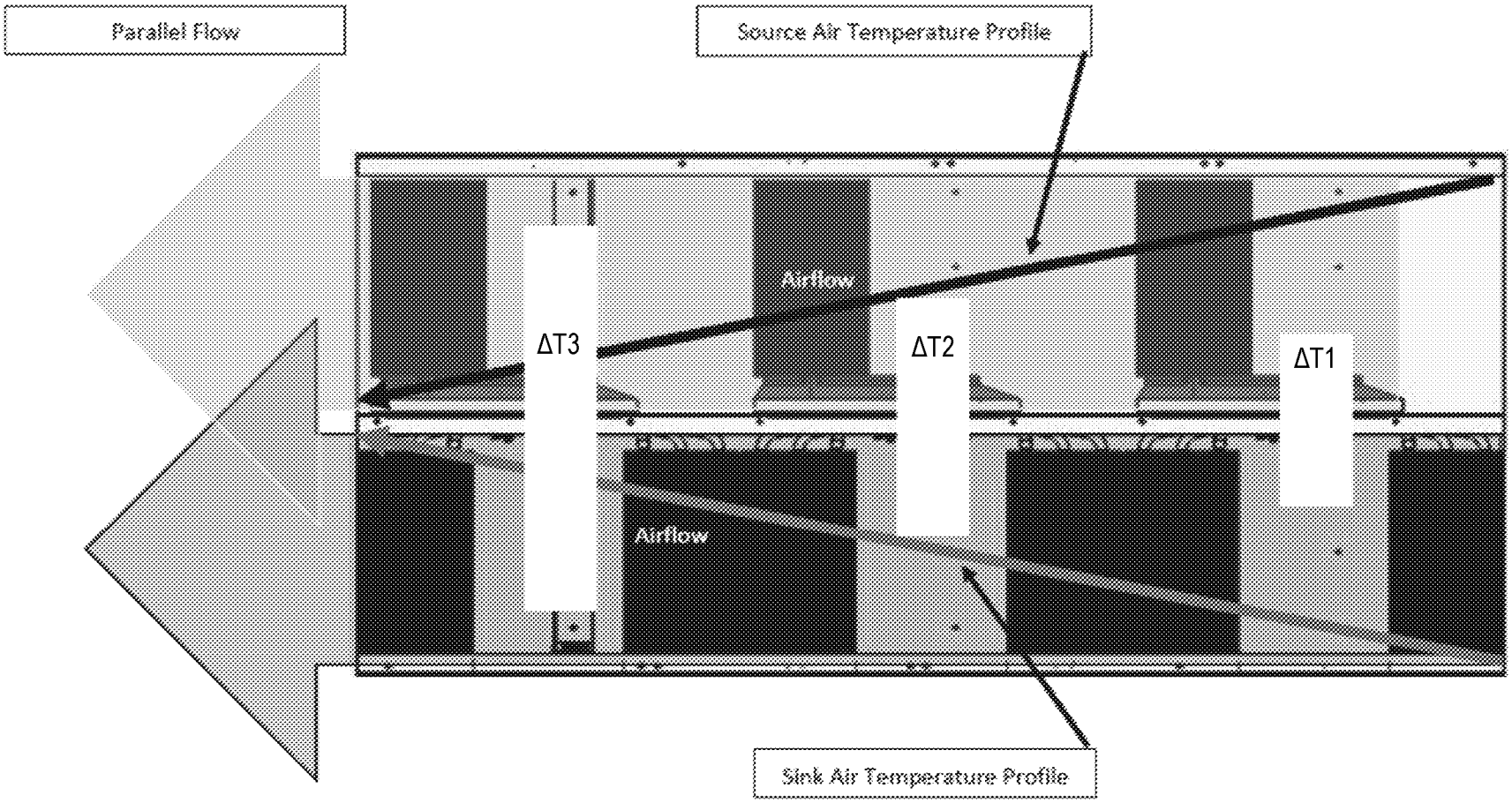
FIG. 2 illustrates a heat exchanger with parallel air flow.

If not configured this way, the first reject (sink) stage will have the smallest temperature delta between the hot and cold sides and each subsequent stage will have a larger delta, dominated by the reject temperature rise, resulting from the pumped heat load, in combination with the work done by the system being rejected together, through the reject heat-exchanger to ambient. This condition is further exacerbated when combined with the higher absolute temperature average, each subsequent, downstream, sink stage will operate at resulting from stage pre-heating from the output of upstream modules. Because of this different average operating temperature, each stage will have an demonstrably different material property, operation and control optimization curve. In fact, this basic configuration has a high likelihood, if implemented improperly, of adversely affecting the performance of the overall system and minimizing or even negating the potential performance improvement, being targeted, by increasing the functional delta(s) of the individual, downstream, sub-delta module(s), marginalizing the down-stream module(s) potential impact on system capacity as well as degrading the upstream module(s) performance by significantly reducing heat absorption capacity on the accept (source) side of the system (FIG. 2). While the sub-delta breakdown is generally considered desirable in modeling, the non-optimized effect, can be more hurtful than helpful if not properly considered in conjunction with the entire system architecture and operating parameters.

Figure 3:
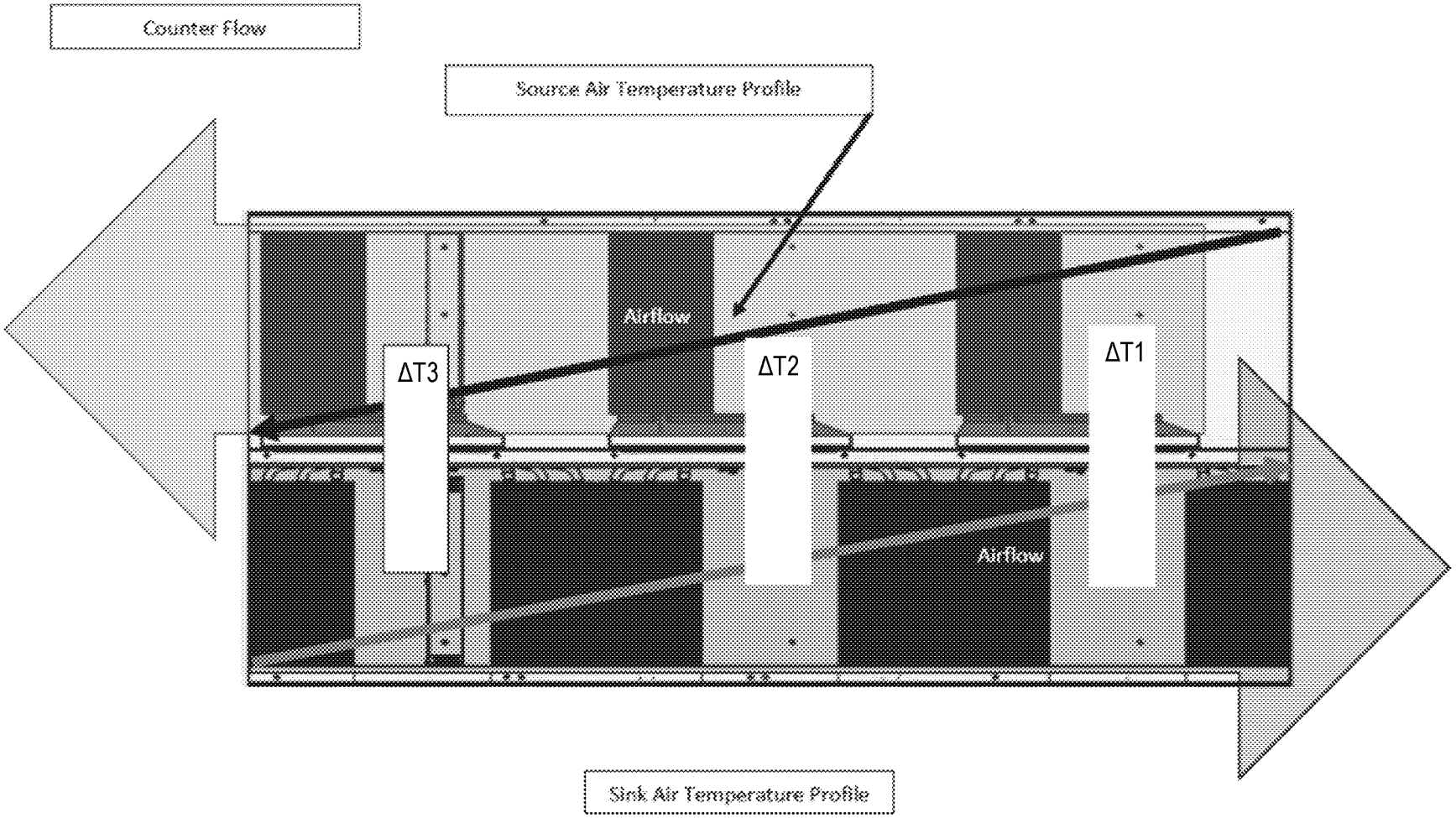
FIG. 3 illustrates a heat exchanger with counter air flow.

When implemented in the described series/counter-flow configuration, the sub-delta systems are now being loaded from high to low (hottest to coldest) on the source side and low to high (coldest to hottest) on the sink side. Doing this will allow for the individual sub-delta modules to now operate at similar deltas but with differing absolute temperature averages (FIG. 3). This allows the system to potentially pump the maximum amount of energy from the system with the minimum amount of energy consumption.

Figure 4A:
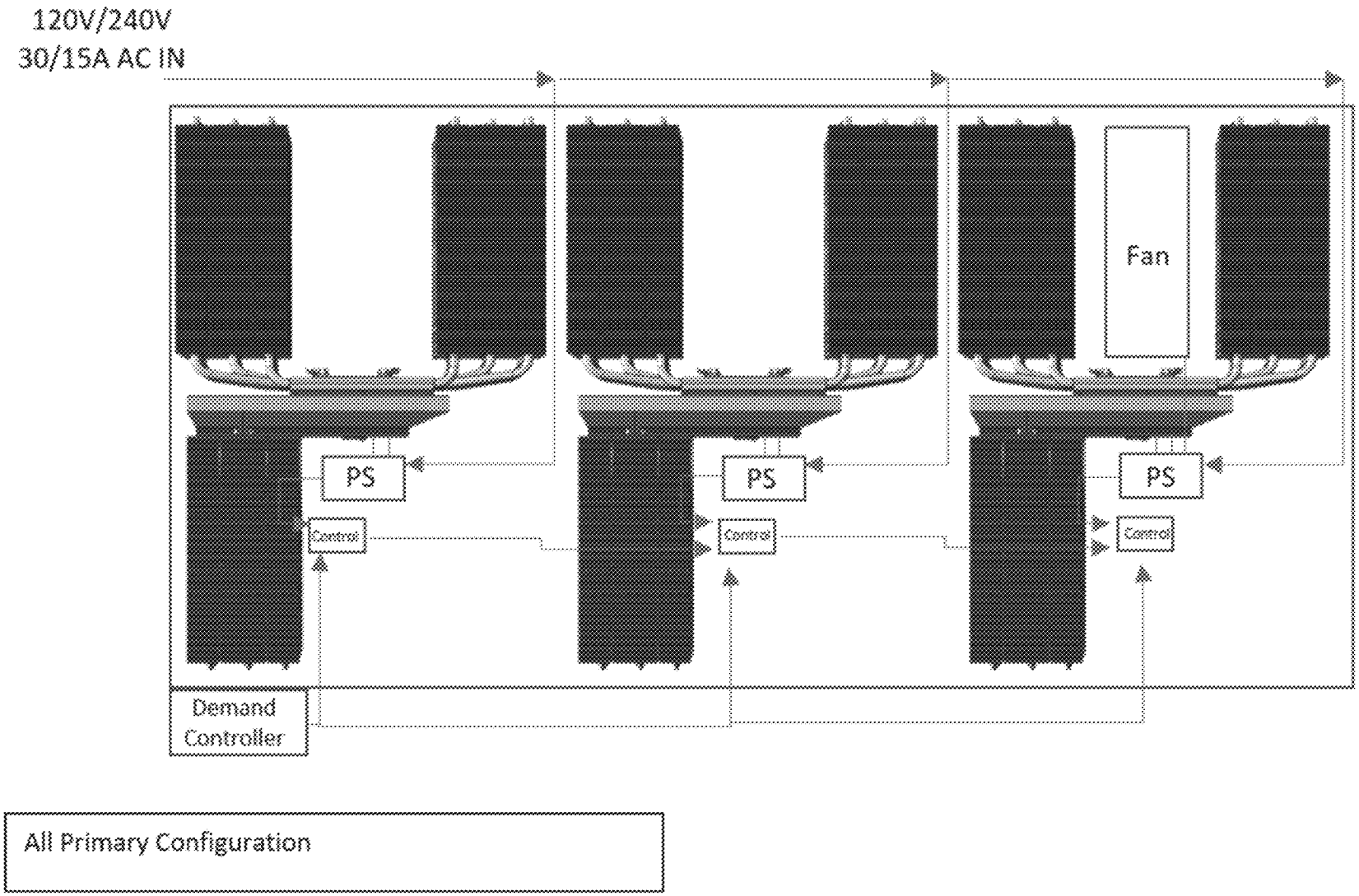
FIGS. 4A and 4B illustrate an example where the heat exchanger series sub-delta modules can be optimized to function as all Primary.
Figure 4B:
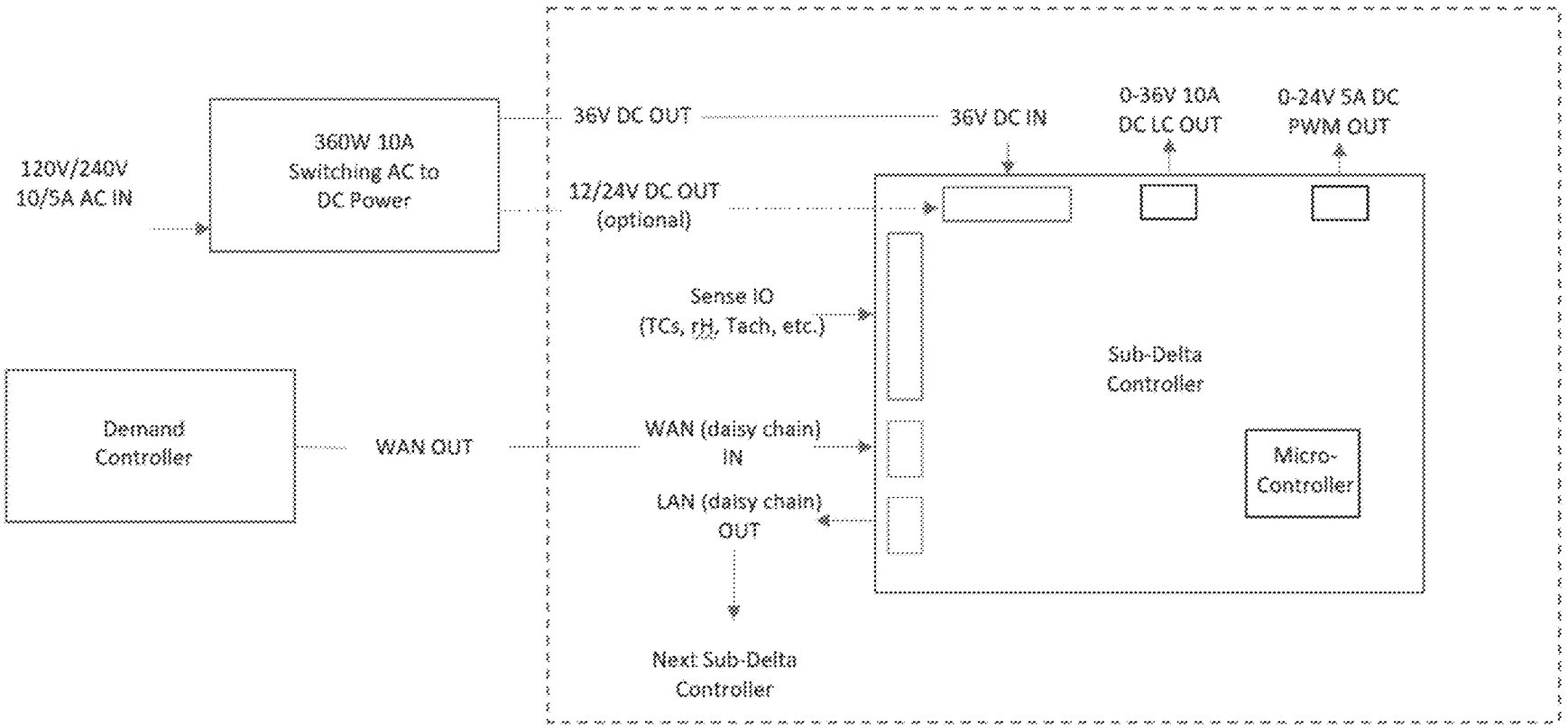
Figure 5A:
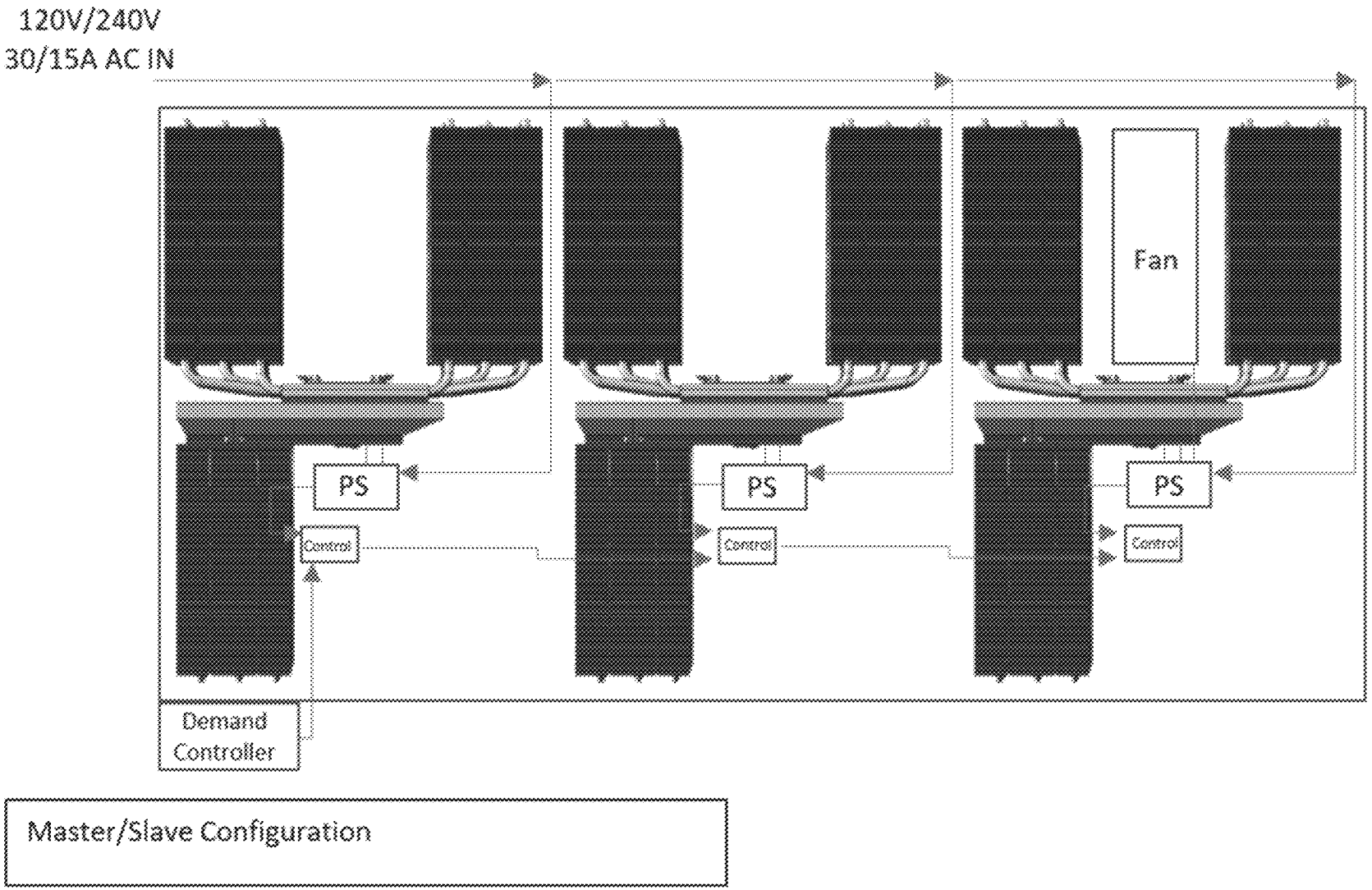
FIGS. 5A and 5B illustrate an example where the heat exchanger series sub-delta modules can be optimized to function as a master/slave arrangement.
Figure 5B:
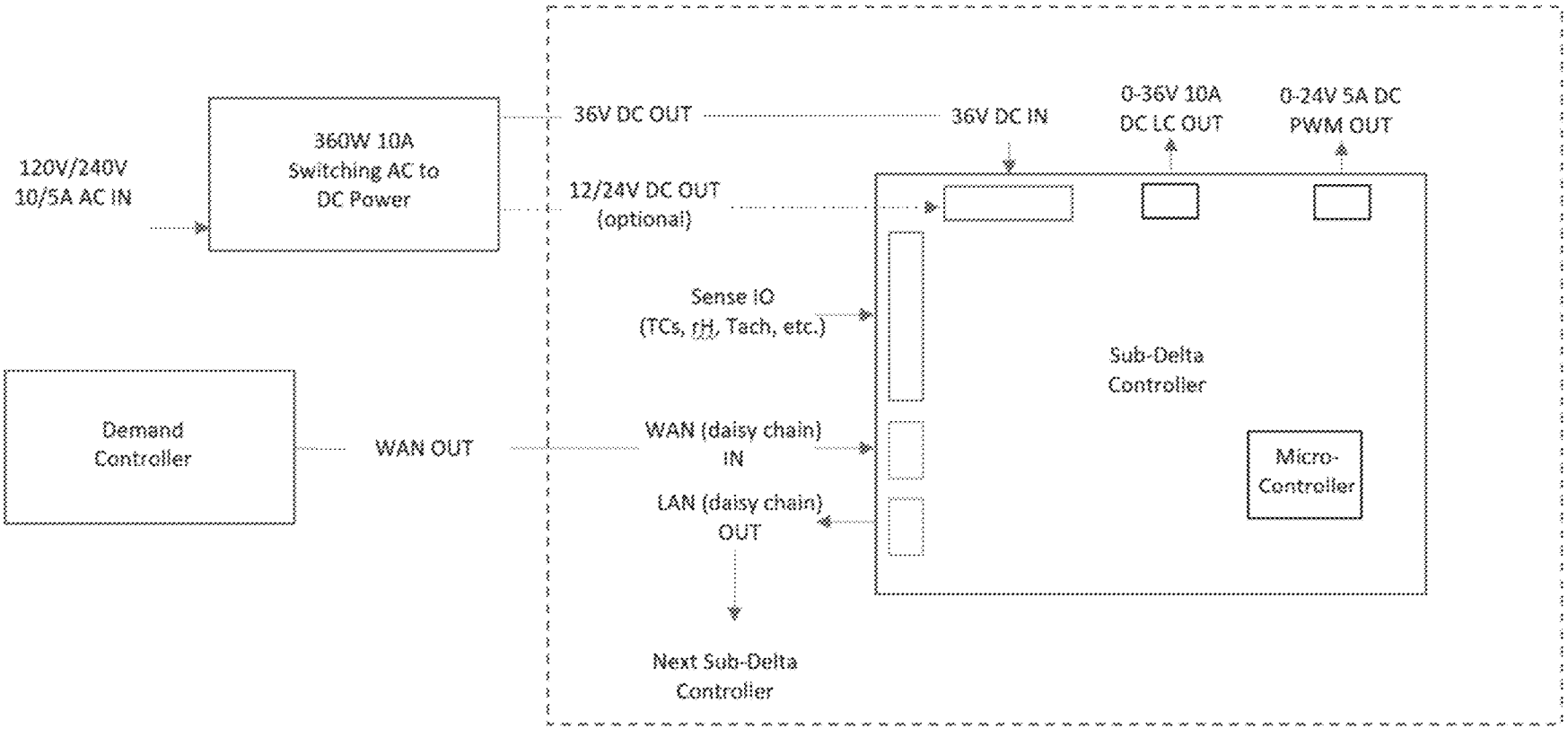

However, there is at least one more critical element. Each sub-delta system must be operated and controlled at different points of optimization, that are both independent and interdependent on the other sub-delta modules in the series. This method of controlling the various sub-delta modules is the last major contributor to optimal system level performance. The series sub-delta modules can be optimized to function either as all Primary (FIGS. 4A and 4B), as a master/slave (Primary, secondary, tertiary, etc.) (FIGS. 5A and 5B), or a mixture of both configurations. In some embodiments, the relative humidity is used as one of the input variables. In some embodiments, the system adjusts the relative humidity in the reject-side and/or the accept-side. In some embodiments, the heat exchanger is controlled to purposely cause the condensation of water at a specific location in the heat exchanger. This can be used to protect some systems in the heat exchanger or to aid in water removal. In some embodiments, the humidity of the reject-side is increased. This could be from the water captured from the accept-side or otherwise provided. This increased humidity of the reject-side can increase the heat carrying capacity of the reject-side.

In the All Primary configuration the sub-delta modules will all receive the Demand control signal and individually optimize for maximum efficiency while communicating with the appropriate sub-delta modules sharing the overall load on a separate sub-network (FIG. 3). In the master/slave configuration, the primary (master) sub-delta module interfaces with the demand control through a direct interface (wireless, WAN, direct wire, etc.) and optimizes the operating point for itself based on the current demand signal and environmental conditions. In a dynamic loop, the Primary then initiates control commands on a separate local network that drive the lateral/up/down-stream sub-delta modules as a proprietary function of their location in the network and the optimized condition determined from the demand signal and the environmental conditions (FIG. 5).

In any control system, striving for maximum efficiency and performance, the ultimate outcome of this system is to provide the optimum system operating point based on demand and sensor feedback available. For Thermoelectric systems, each configuration will exhibit a predictable performance envelope for Capacity and Efficiency (COP) based on the operating temperature delta and the power input. As such, each individual sub-stage module will need to be able to determine the optimal operating conditions for its own contribution, based on not only the overall demand but also the individual modules operating in conjunction with it in the same thermal circuit.

Figure 6:
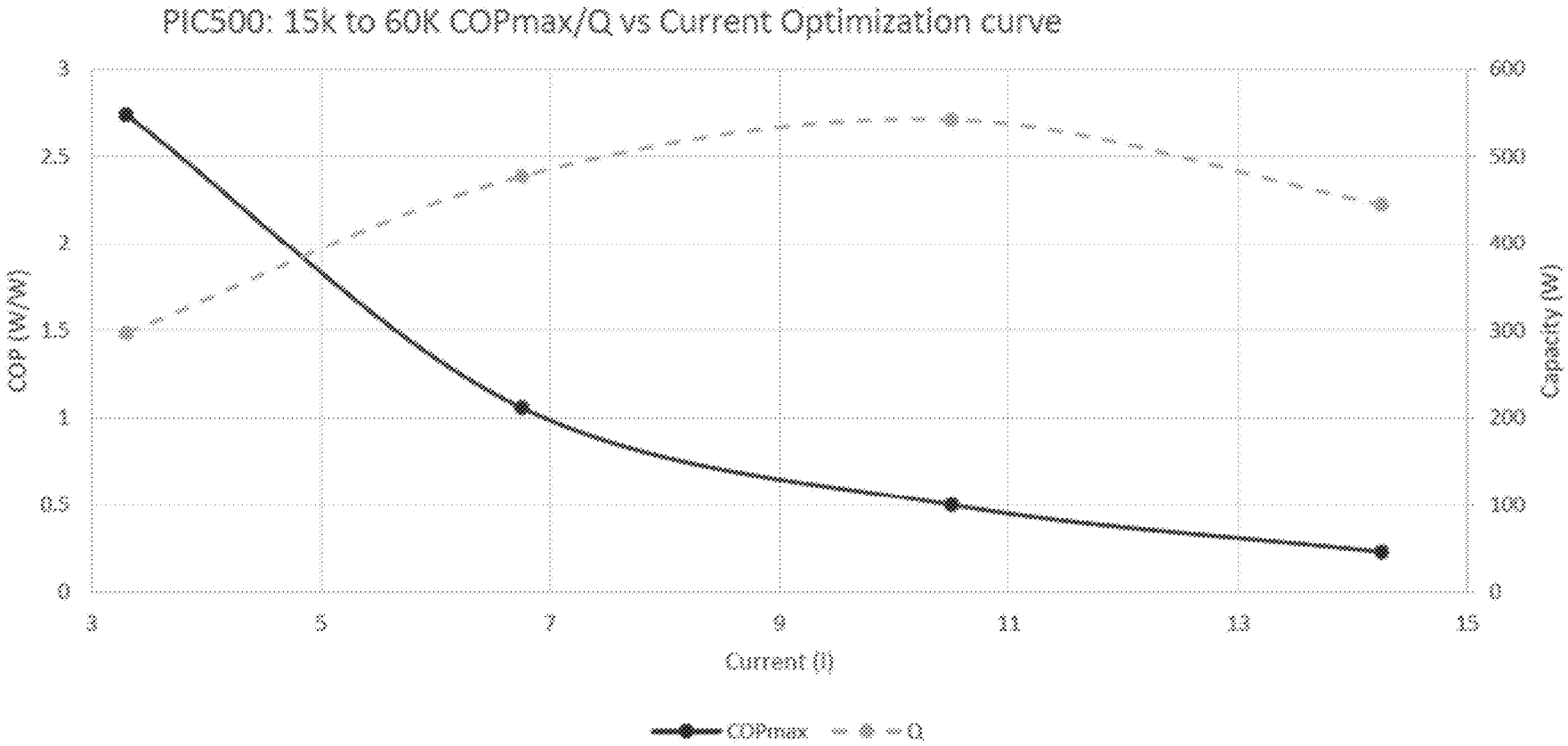
FIG. 6 illustrates a specific example of a capacity and efficiency optimization curve.
Figure 7:
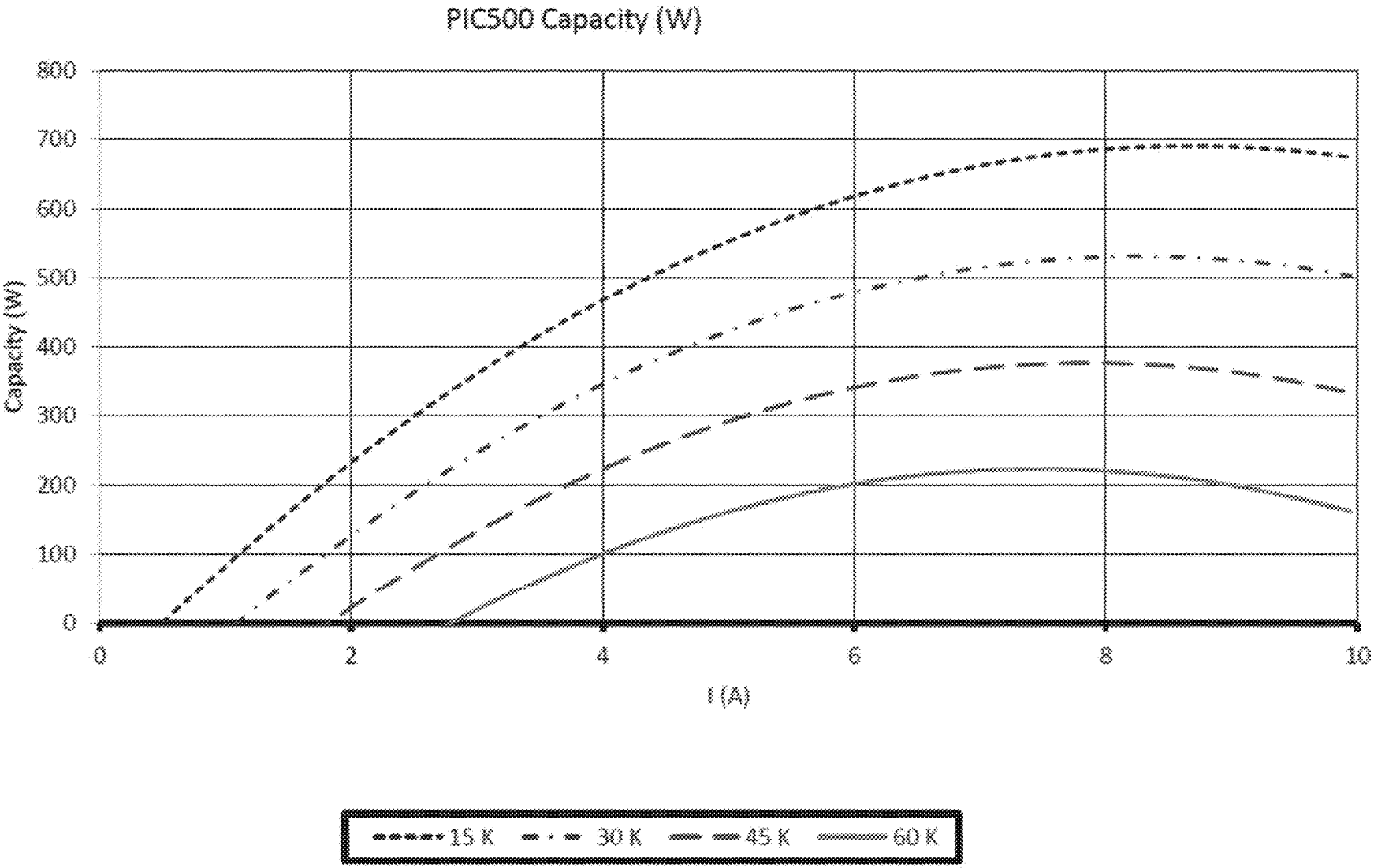
FIG. 7 illustrates the Capacity curve associated with the example in FIG. 6.
Figure 8:
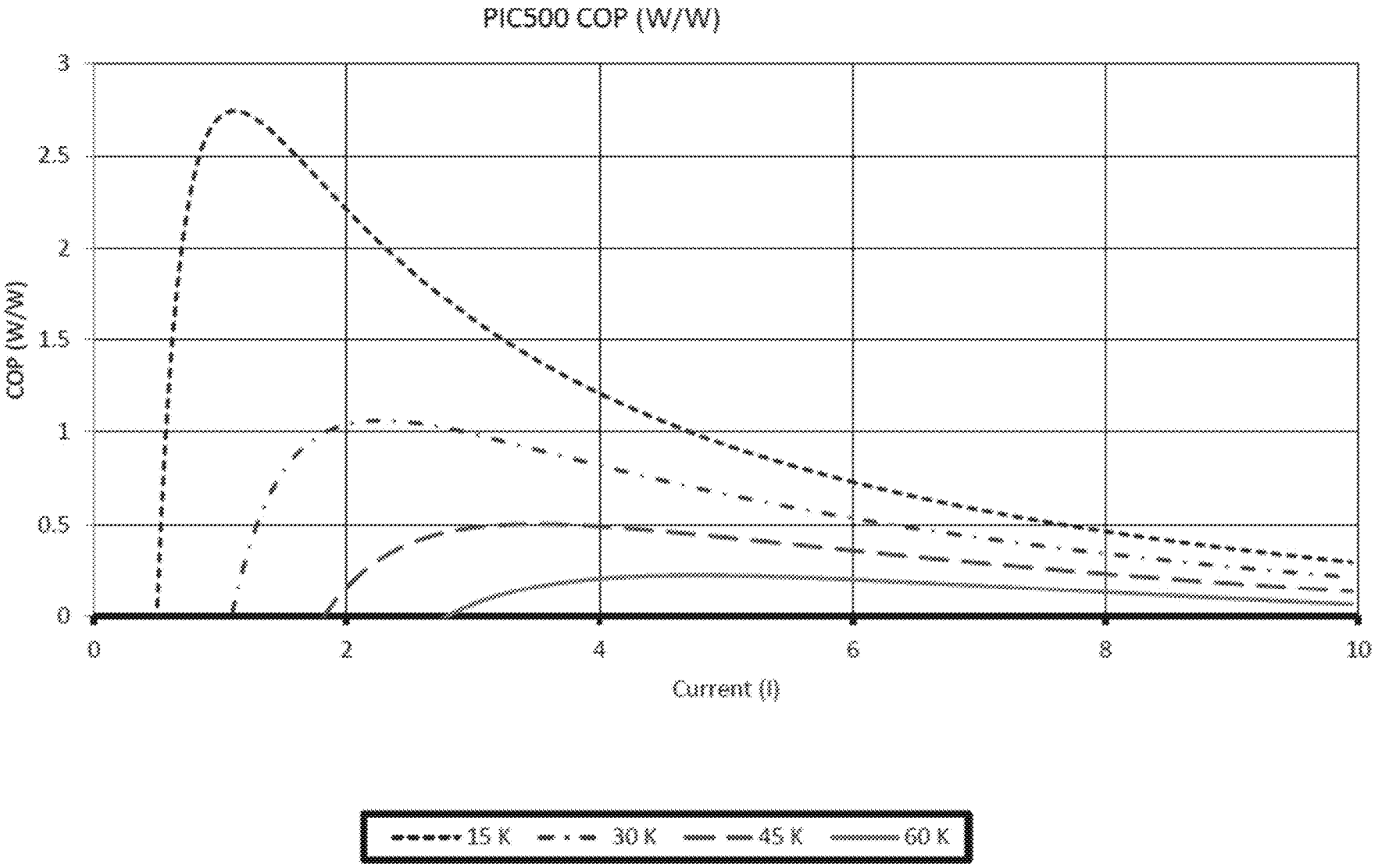
FIG. 8 illustrates the COP curve associated with the example in FIG. 6.
Figure 9:
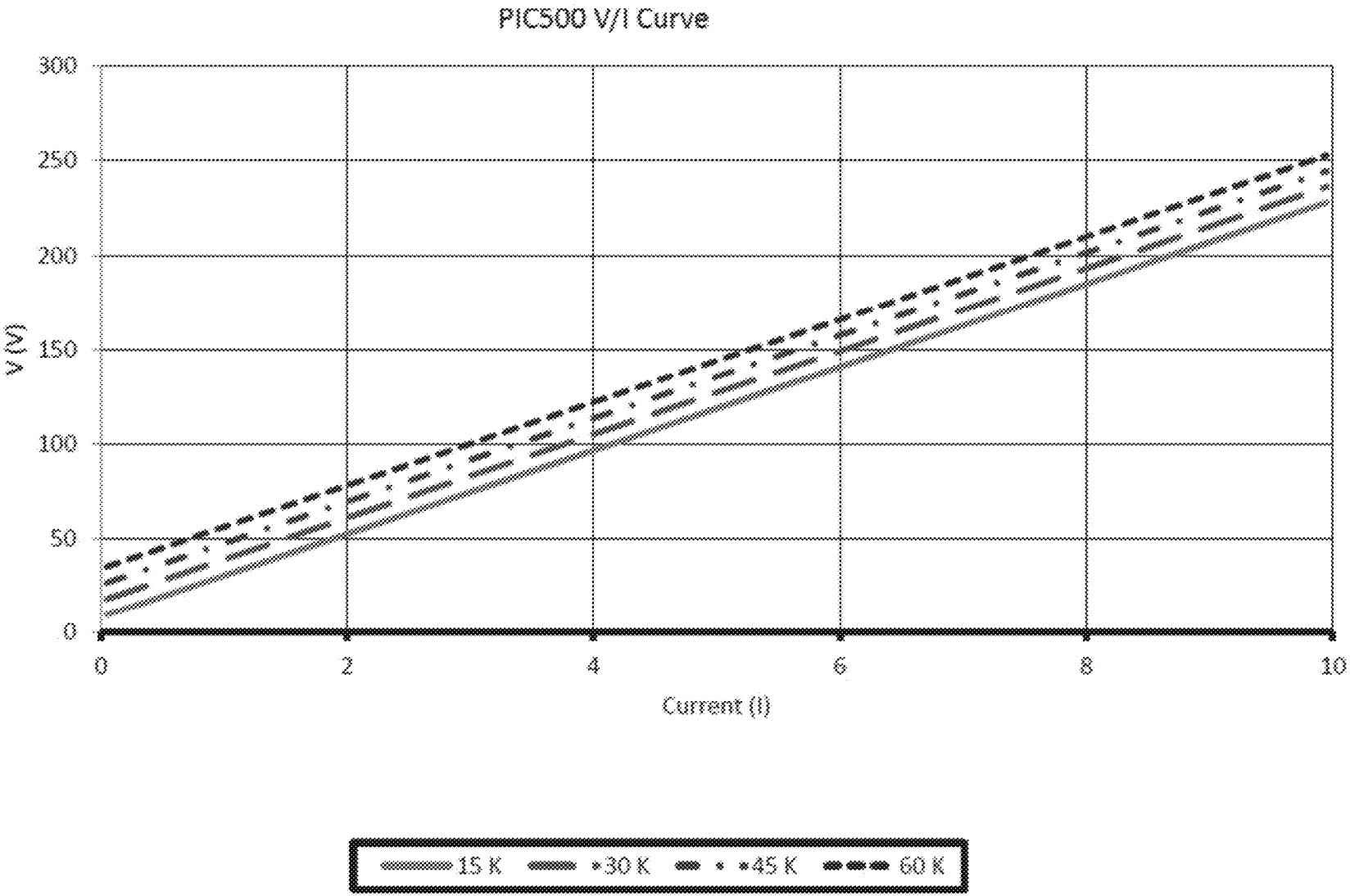
FIG. 9 illustrates the V/I curve associated with the example in FIG. 6.

A specific example of this capacity and efficiency optimization curve can be seen in FIG. 6. This curve is a function of the heat pumping device(s) used, the associated Capacity curve (FIG. 7), COP curve (FIG. 8), V/I curve (FIG. 9) and the resulting temperature deltas, created by the heat transport system and internal parasitics for a given loading. It is a fundamental and unique characteristic of the complete system architecture. The control system can use this unique resultant characterization, to optimize each sub-delta module(s) based on the demand and stabilized operating condition of the other modules in the thermal circuit. In this way the overall system performance can be maximized for the best possible outcome available at any system operating conditions.

Those skilled in the art will recognize improvements and modifications to the preferred embodiments of the present disclosure. All such improvements and modifications are considered within the scope of the concepts disclosed herein and the claims that follow.

What is claimed is:

1. A method of controlling a heat exchanger comprising a plurality of thermoelectric coolers to provide conditioned air, the method comprising:

receiving system measurements indicative of one or more of the group consisting of:

a temperature of a accept-side of a first thermoelectric cooler;

a temperature of a reject-side of the first thermoelectric cooler;

a temperature of a accept-side of a second thermoelectric cooler;

a temperature of a reject-side of the second thermoelectric cooler;

and an indication of a relative humidity value; and selectively controlling two or more subsets of thermoelectric coolers in the plurality of thermoelectric coolers based on the received system measurements;

wherein a direction of air flow in the heat exchanger comprises counter air flow where an accept-side flow of mass proceeds from a hottest to a coldest of the two or more subsets of thermoelectric coolers, and a reject-side flow of mass proceeds from the coldest to the hottest of the two or more subsets of thermoelectric coolers;

wherein selectively controlling the two or more subsets of thermoelectric coolers comprises: being able to provide more equal power to the two or more subsets of thermoelectric coolers.

2. The method of claim 1, wherein the system measurements further comprise an indication of a volume of air flow.

3. The method of claim 1, wherein selectively controlling the two or more subsets of thermoelectric coolers comprises: optimizing a system-level efficiency of the heat exchanger.

4. The method of claim 1, wherein selectively controlling the two or more subsets of thermoelectric coolers comprises: providing an overall temperature difference by providing a smaller temperature difference over each of the two or more subsets of thermoelectric coolers.

5. The method of claim 1, wherein selectively controlling the two or more subsets of thermoelectric coolers comprises: adjusting the relative humidity in one or more of: the reject-side; and accept-side.

6. The method of claim 1, wherein the heat exchanger comprises a plurality of controllers to selectively control the two or more subsets of thermoelectric coolers.

7. The method of claim 1, wherein each subset of thermoelectric coolers includes one or more different thermoelectric coolers from the plurality of thermoelectric coolers.

8. A controller for controlling a heat exchanger comprising a plurality of thermoelectric coolers to provide conditioned air, the controller being capable of:

receiving system measurements indicative of one or more of the group consisting of:

a temperature of a accept-side of a first thermoelectric cooler;

a temperature of a reject-side of the first thermoelectric cooler;

a temperature of a accept-side of a second thermoelectric cooler;

a temperature of a reject-side of the second thermoelectric cooler;

and an indication of a relative humidity value; and selectively controlling two or more subsets of thermoelectric coolers in the plurality of thermoelectric coolers based on the received system measurements;

wherein a direction of air flow in the heat exchanger comprises counter air flow where the accept-side flow of mass proceeds from a hottest to a coldest of the two or more subsets of thermoelectric coolers, and the reject-side flow of mass proceeds from the coldest to the hottest of the two or more subsets of thermoelectric coolers;

wherein selectively controlling the two or more subsets of thermoelectric coolers comprises: being able to provide more equal power to the two or more subsets of thermoelectric coolers.

9. The controller of claim 8, wherein the system measurements further comprise an indication of a volume of air flow.

10. The controller of claim 8, wherein selectively controlling the two or more subsets of thermoelectric coolers comprises: optimizing a system-level efficiency of the heat exchanger.

11. The controller of claim 8, wherein selectively controlling the two or more subsets of thermoelectric coolers comprises: providing an overall temperature difference by providing a smaller temperature difference over each of the two or more subsets of thermoelectric coolers.

12. The controller of claim 8, wherein selectively controlling the two or more subsets of thermoelectric coolers comprises: adjusting the relative humidity in one or more of: the reject-side; and accept-side.

13. The controller of claim 8, wherein the heat exchanger comprises a plurality of controllers to selectively control the two or more subsets of thermoelectric coolers.

14. The controller of claim 8, wherein each subset of thermoelectric coolers includes one or more different thermoelectric coolers from the plurality of thermoelectric coolers.

15. The method of claim 1, further comprising:

increasing a humidity of the reject-side of the heat transport system to increase the heat carrying capacity of the reject-side.

16. The method of claim 1, wherein selectively controlling two or more subsets of thermoelectric coolers comprises:

operating the two or more subsets of thermoelectric coolers in a master/slave configuration, where a single subset determines the system-level optimal operating point and dictates the control commands to the remaining subsets.

17. The method of claim 1, wherein selectively controlling two or more subsets of thermoelectric coolers comprises:

operating the two or more subsets of thermoelectric coolers in an all-primary configuration, where each subset independently calculates its own control command while communicating its operating status to the other subsets.

18. The controller of claim 8, further being capable of:

increasing a humidity of the reject-side of the heat transport system to increase the heat carrying capacity of the reject-side.

19. The controller of claim 8, wherein selectively controlling two or more subsets of thermoelectric coolers comprises:

operating the two or more subsets of thermoelectric coolers in a master/slave configuration, where a single subset determines the system-level optimal operating point and dictates the control commands to the remaining subsets.

20. The controller of claim 8, wherein selectively controlling two or more subsets of thermoelectric coolers comprises:

operating the two or more subsets of thermoelectric coolers in an all-primary configuration, where each subset independently calculates its own control command while communicating its operating status to the other subsets.

* * * * *